US006877609B2

(12) United States Patent
Barker et al.

(10) Patent No.: US 6,877,609 B2
(45) Date of Patent: Apr. 12, 2005

(54) PRODUCT PACKAGING

(75) Inventors: Lee Barker, Bradford (GB); Jenny Bravo, Royal Palm Beach, FL (US)

(73) Assignee: Pace Micro Technology Plc., Saltaire (GB)

( * ) Notice: Subject to any disclaimer, the term of this patent is extended or adjusted under 35 U.S.C. 154(b) by 133 days.

(21) Appl. No.: 09/956,567

(22) Filed: Sep. 19, 2001

(65) Prior Publication Data

US 2002/0189971 A1 Dec. 19, 2002

(30) Foreign Application Priority Data

Jun. 15, 2001 (EP) ..... 01305253

(51) Int. Cl.[7] ..... B65D 85/30
(52) U.S. Cl. ..... 206/722; 206/784
(58) Field of Search ..... 206/722, 725, 206/723, 721, 701, 769, 772, 320, 576, 784

(56) References Cited

U.S. PATENT DOCUMENTS

| | | | | | |
|---|---|---|---|---|---|
| 2,983,368 | A | * | 5/1961 | Lugt, Jr. | 206/470 |
| 3,872,966 | A | * | 3/1975 | Gordon et al. | 206/772 |
| 4,865,187 | A | * | 9/1989 | Zulauf et al. | 206/772 |
| 5,099,991 | A | * | 3/1992 | Kitagawa et al. | 206/723 |
| 5,469,692 | A | | 11/1995 | Xanthopoulos | 53/474 |
| 5,477,966 | A | * | 12/1995 | Ogawa | 206/723 |
| 5,823,352 | A | * | 10/1998 | Mena et al. | 206/721 |
| 5,996,074 | A | | 11/1999 | Houck et al. | 713/2 |
| 6,142,298 | A | | 11/2000 | Wu | 206/305 |

FOREIGN PATENT DOCUMENTS

| | | | |
|---|---|---|---|
| DE | 7631 185 U | 5/1977 | B65D/5/54 |
| EP | 0 488 094 A1 | 11/1991 | B65D/5/72 |
| FR | 2 628 708 | 3/1988 | B65D/5/52 |
| WO | WO 96/01765 | 1/1996 | B65D/5/02 |

* cited by examiner

*Primary Examiner*—Jacob K. Ackun, Jr.
(74) *Attorney, Agent, or Firm*—Head, Johnson & Kachigian

(57) ABSTRACT

The invention relates to a package and method of transportation for items of electrical apparatus. The items are required to be packaged for transport from the manufacturing location to a storage facility and then on to an end user. At the storage facility, preinstallation checks and procedures, also called staging, are performed on the items of apparatus including, in some instances the downloading of software and control features via electrical connection. The invention avoids the conventional need to remove the items of apparatus at the storage location for the performance of the checks and procedures by providing a package with selectively removable portions which, when removed, allow the required access to the components of the apparatus without needing to remove same from the package.

20 Claims, 4 Drawing Sheets

PRODUCT PACKAGING

CROSS-REFERENCE TO RELATED APPLICATION

This application claims priority to European Patent Application No. 01305253.5 filed 15 Jun. 2001.

The invention relates to packaging and an installation procedure for apparatus contained within said packaging. The invention is particularly, but not necessarily exclusively, directed towards the provision of packaging for electrical apparatus and which allows said electrical apparatus to be the subject of preinstallation procedures such as electrical testing, software downloads, and/or other procedures.

Conventionally, many items of electrical apparatus such as, for example, broadcast data receivers, are required to be packaged once manufactured at the place of manufacture, shipped for storage at a number of storage locations and, from the storage location, supplied and installed at a user's premises. With broadcast data receivers, the same are required to be taken to the premises and installed by being connected to a data transmission network which can be any of satellite, cable or terrestrial systems, and the apparatus is also required to be connected to a display screen such as that of a television set. However, subsequent to manufacture but prior to delivery to the premises the apparatus is required to undergo preinstallation checks and procedures, also known as "staging".

Conventionally, the procedure involves personnel at each storage location, removing the items from the packaging in which the same have been delivered, including removing the same from any protective bags, performing the required tests, and downloading any appropriate software onto the apparatus, and then repacking the product in new packaging for subsequent delivery. This can however lead to several problems as outlined below.

A first problem is that personnel are required to spend time unpacking and then subsequently repacking the items at the storage locations. There is also the problem of the waste packaging and the need to discard it safely and the expense involved in doing so. There is also the need for additional packaging to be obtained for the repacking of the items. In some instances certain items to go with the apparatus such as manuals, remote control devices and the like can go missing during the unpacking and packing procedure.

SUMMARY OF THE INVENTION

The aim of the invention is to overcome the current problems in a manner which allows efficient and effective performance of the preinstallation checks and procedures without the need to pack and unpack the items.

In a first aspect of the invention there is provided a package, said package including a housing with a series of location means therein, each locating means containing an item of electrical apparatus therein, and characterized in that said housing includes at least one removable portion to allow the selective removal of the same and access to be gained to a particular component of each of the items of electrical apparatus in the package.

Thus the package of the present invention prevents the need of the item of apparatus to be removed from the package prior to the actual installation of the same but still allows preinstallation staging, checks and procedures to be performed without the item having to be removed from the package.

Preferably the location for each item is of a shape or includes instructions which determine the required orientation of the item with respect to the location.

In one embodiment a plurality of removable portions are provided at each item location in the package to allow access to be gained to a number of components at spaced locations on each item.

In one embodiment the package comprises a cardboard housing, containing a number of items and means for locating the items in the housing. In one embodiment each item locating means comprises a sleeve and when placed together in the housing, adjacent sleeves are positionable with respect to each other so as to position each of the items of apparatus in definable and determinable positions with respect to the housing and hence the selectively removable portions.

In one embodiment the item of apparatus may be further placed in a plastic bag and, in accordance with the invention the bags are clear so as to allow the visual testing of the apparatus without the need to remove the item from the bag.

Typically the portions are defined by weakening lines which are such as to allow the same to be torn to remove the same.

In a further aspect of the invention there is provided a method of supplying a number of items of electrical apparatus from a manufacturer to an end user, said method comprising the steps of placing the items in a packaging housing for transport to a storage location and then subsequently moving the items to locations for end use, and, at the storage location, a series of preinstallation checks and procedures are required to be performed on the items of apparatus and characterized in that a series of items are placed in a package housing, each item of apparatus positioned in the housing in a determinable position with respect to the housing and said housing includes at least one aperture and/or removable portion positioned with respect to the known positions of the items of apparatus such that the aperture and/or the aperture formed by the selective removal of the removable portion, allows access to components of the items to perform the procedures and checks at the storage location.

In one embodiment the procedures and checks at the storage location include any or any combination of visual checks, electrical operation set up and/or software downloads to configure the item of apparatus for operation in a specific area.

Typically the items of apparatus are each first placed in location means and positioned in the housing with the location means. In a preferred embodiment the items of apparatus can be delivered to the end user in the location means.

In one preferred embodiment the checks and procedures are performed on the items of apparatus with the items located in the housing.

Alternatively, at the storage location, the items are removed from the housing still in the location means and the checks and procedures performed.

Thus the method as herein described allows the testing to be performed on the items of apparatus without the need for the items to be removed from the housing.

BRIEF DESCRIPTION OF THE DRAWINGS

A specific embodiment of the invention is now described with reference to the accompanying diagrams wherein.

DESCRIPTION OF THE PREFERRED EMBODIMENTS

The invention is now described with reference to the procedure followed in the transfer of items of electrical apparatus in the forms of broadcast data receivers and the preinstallation tests and procedures required to be performed on this type of apparatus.

For example, for broadcast data receivers pre-installation tests can include or comprise software downloads and in this case the goal is not to test the items but to provide on the item necessary data such as headend and authorisation services and other services which may be peculiar to a specific area of operation and therefore cannot be included at a centralised manufacturing location which may even be in another country. Thus the preinstallation procedures can effectively allow the items of electrical apparatus to be "customized" for subsequent operation in a specific area, typically the area around that particular storage location.

Thus, when the items are shipped from the manufacturing facility to a storage location, which may be that of a company or supply customer for whom the items of apparatus have been manufactured, the items are preinstalled or staged. In this example, the process includes serially downloading all the services to be provided by that company to their end customers via the item of apparatus. Other services may include the provision of a security feature by allocating a unique security code; the uploading of each item into a billing system and loading it on to a particular service provider's headend database thereby ensuring that data can subsequently be received from the headend or data transmitter.

Once this is performed each item is delivered and installed by the installer at end user's premises.

While the invention is now described with reference to the broadcast data receivers as the items of apparatus it should be clear that the invention is useful and the application applies to the packaging and transport procedures of any form of electrical apparatus which requires pre-installation checks and procedures to be performed prior to the actual installation of the same.

With reference to the subsequent Figures the packaging used in this embodiment of the invention comprises plastic bags 2, one for each item of apparatus in the package, a cardboard sleeve 4 and a housing 6 typically also made of card.

Figure 1C:
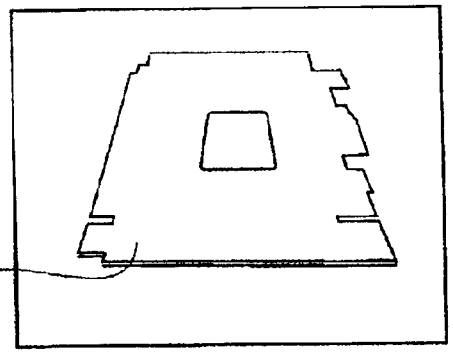
FIGS. 1A–I illustrate a packing procedure in accordance with the invention.
Figure 1B:
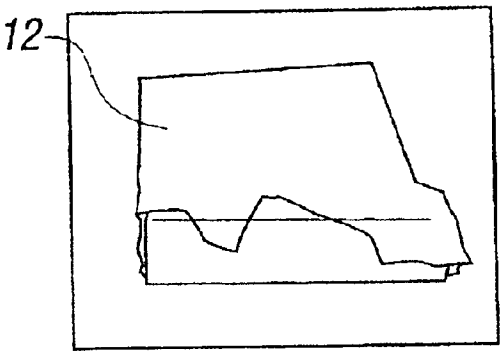
Figure 1A:
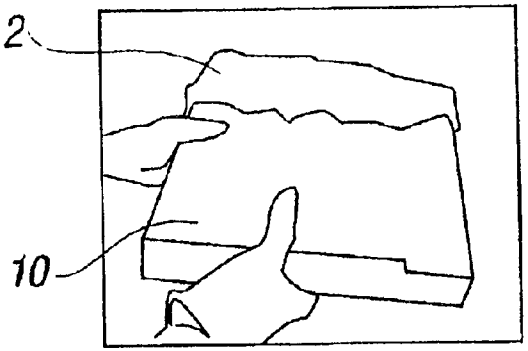
Figure 1E:
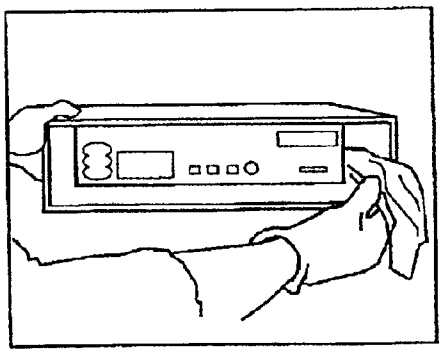
Figure 1D:
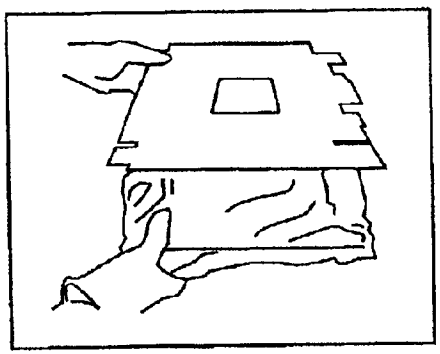
Figure 1G:
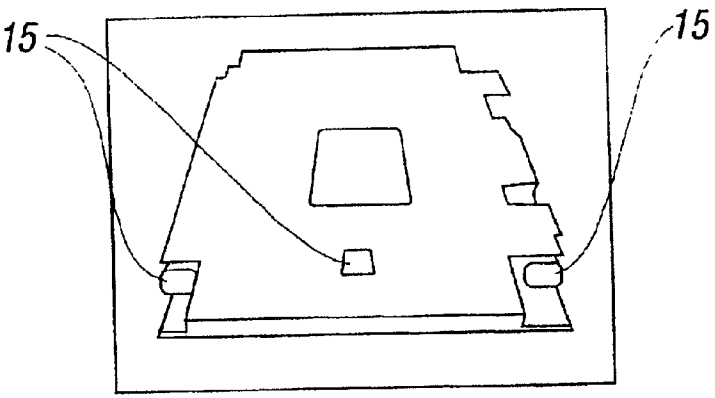
Figure 1I:
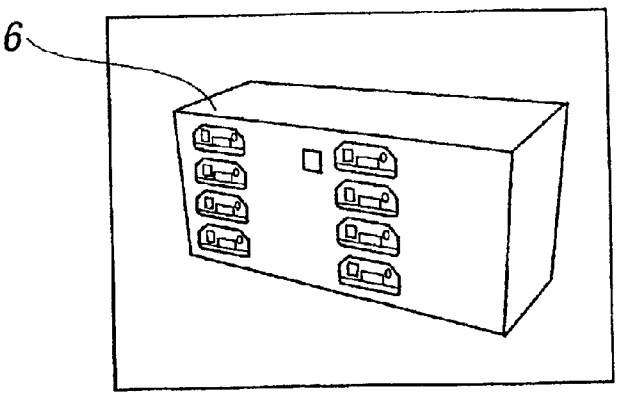
Figure 1F:
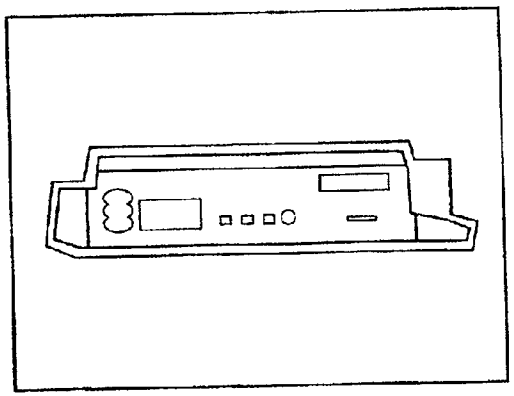
Figure 1H:
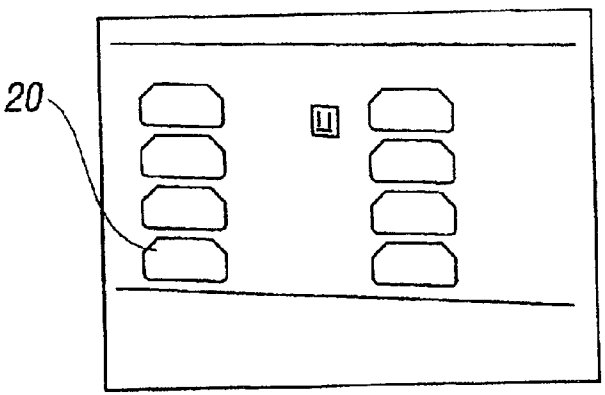

Referring firstly to FIGS. 1A–I the procedure followed at the location of manufacture is shown. Each of the items of electrical apparatus 10 is placed into a plastic bag 2 along with any other material, such as instruction and/or installation manuals, power cables 12. The item and bag is then placed in a designated orientation into the sleeve 4 as shown in FIG. 1D which serves to locate the item in position and also prevent the other materials 12 from exiting the bag via flaps 15 shown in FIG. 1G and becoming mislaid during transit.

The sleeve with the item therein is then placed is a designated orientation in the housing 6. In the embodiment shown in FIGS. 1H and I the housing 6 is provided with a series of apertures 20, each located with respect to a known location of an item of electrical apparatus to allow the product information codes to be viewed and/or connections to be made as herein described.

As the sleeves are provided for each item, when the same are all placed in the housing the position of each item of apparatus with respect to the sleeve and hence with respect to the housing can be determined with a considerable degree of accuracy. Each sleeve also includes apertures positioned as required so as to ensure that access can be gained to required components of the item of apparatus to allow the preinstallation tests and checks to be performed.

With the items all packaged as described, in this case in two columns of four items, the package is complete and can then be shipped from the manufacturing facility to a storage location.

At the storage location no action need be taken until the items are due to be forwarded to various locations for installation and use.

Before this however there is a need for access to be gained to the items to allow the staging preinstallation checks and procedures to be carried out on each of the items. In accordance with the invention, the items need not be removed from the housing or sleeve.

Figure 2A:
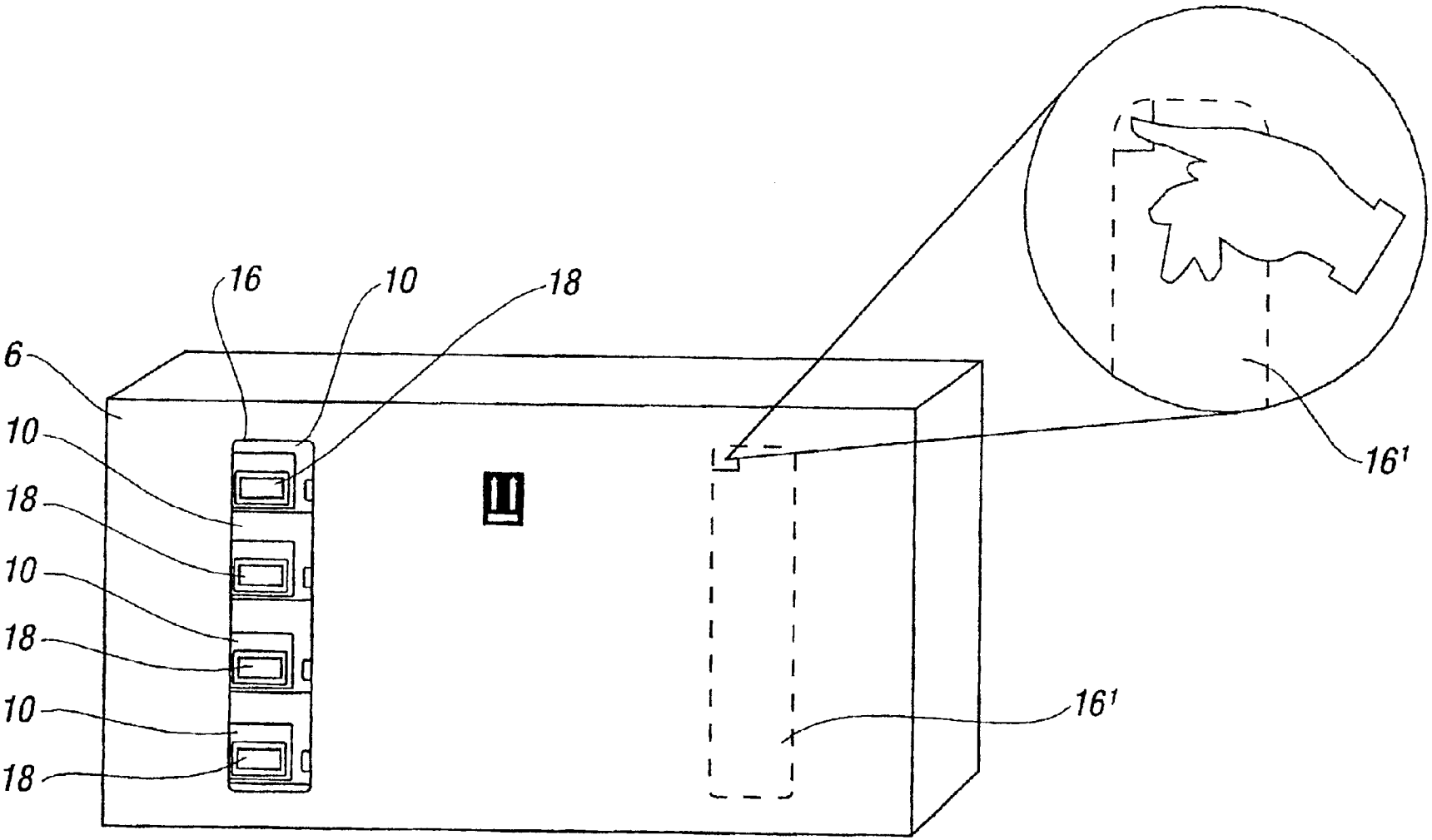
FIGS. 2A and B illustrate the procedure followed for the preinstallation tests and checks.
Figure 2B:
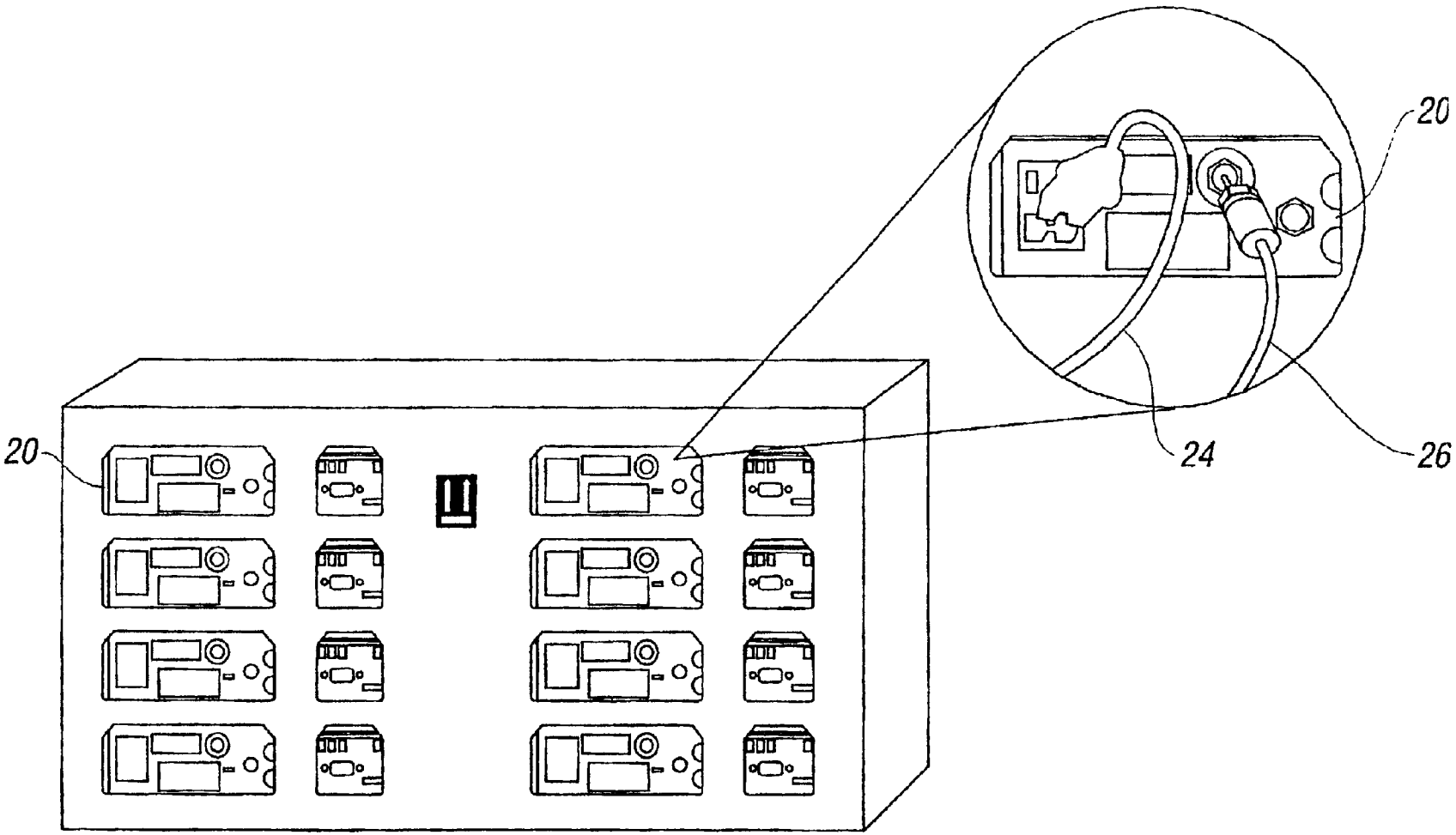

Referring now to FIGS. 2A and 2B there is a need to gain access to the front panel of the item and in particular to a visual display component, typically a 7 segment LED display, of each item of apparatus. In accordance with the invention, on the wall of the housing there are provided selectively removable portions 16,16' as in this case the items of apparatus are positioned two abreast. As the position of the items of apparatus are known and defined in the housing, so the position, shape and size of the removable portions 16,16' can be defined and FIG. 2A illustrates with one of the portions 16 removed to reveal the displays 18 of each of the items 10 in a first column and the subsequent removal of the portion 16' will form another aperture through which another series of displays can be viewed. As explained previously, each item is placed in a plastic bag, however as the bag is formed of clear material, there is no need to remove the same as the visual displays can be easily viewed through the same.

Subsequent to this, each item of apparatus can be individually identified by reading bar code data through an aperture 20 provided at the rear wall of the housing as shown in FIG. 2B, again each aperture positioned with respect to a particular item of apparatus in the housing. In one embodiment these apertures 20 can be provided in an exposed form at all times or again may be formed by the removal of a series of selectively removable portions. It is also shown in FIG. 2B how further apertures can be performed on the rear wall by the provision of selectively removable portions, and this Figure shows the apertures formed when the same have been removed.

To perform the preinstallation checks and procedures a power supply cable 24 and data network cable 26 is connected through the aperture 20 for each item of apparatus. The preinstallation, also referred to as staging, and any other procedures can be performed with reference to the display which is exposed for each item.

When completed, the power and data network cables can be removed and the housing forwarded for subsequent delivery of the items.

It will thus be appreciated that the provision of the package with the removable portions allows the integrity and risk of damage to the items of apparatus to be maintained as previously but also allows testing and staging of the items to be performed without the need to unpack the items prior to the delivery at the premises where the same are to be installed. Alternatively, each item with sleeve can be removed from the housing and then provided to be delivered at the location for installation with the sleeve protecting the same.

In some embodiments the storage locations may prefer to place the items in racks for the preinstallation checks and procedures and while, in accordance with the invention, this is not necessary as the tests and procedures can be performed with the items and sleeves in the housing, the use of racks is still improved with this invention as the items need not be removed from the sleeve for checking but rather can be kept in the sleeves, thereby continuing to protect the item.

A further feature which is preferred is that one of the checks includes a visual check through an aperture in the housing and aperture provided in the sleeve for each item, to ensure that the manual and any other material such as power cable, remote control etc, are present within the bag with the electrical apparatus. Conventionally this visual check would not have been possible without removing the packaging for each item and then repacking the same.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A package, said package comprising: a housing with a series of locating means therein having at least one open end, a top, a bottom and first and second sides, each locating means containing an item of electrical apparatus therein, and wherein said housing includes at least one removable portion aligned with and in communication with the at least one open end of the locating means to allow the selective removal of the portion and access to be gained to a particular component of each of the items of electrical apparatus in the package to allow the supply of power to the electrical apparatus and selective operation of the electrical apparatus while the same is retained in the package.

2. A package according to claim 1 wherein selective removal of said removable portion allows visual, electrical or mechanical access.

3. A package according to claim 1 wherein said shape of each locating means determines the orientation of the same in said housing.

4. A package according to claim 1 wherein a plurality of removable portions are provided on said housing.

5. A package according to claim 4 wherein there is provided at least one removable portion for each item of apparatus located in said package.

6. A package according to claim 5 wherein a set of removable portions are provided in said housing for each item of electrical apparatus.

7. A package according to claim 1 wherein removable portions are provided in said housing such that, when removed, common components of each of the items of said apparatus in said package can be accessed.

8. A package according to claim 1 wherein the component on each item which is accessed by removal of said removable portion or portions is the visual display of each item.

9. A package according to claim 1 wherein each item of apparatus is packaged in a clear plastic bag prior to placement in said locating means.

10. A package according to claim 1 wherein said locating means include at least one aperture positioned to allow a visual check for components packed with each item of apparatus.

11. A package according to claim 1 wherein said housing and said locating means are made from board material.

12. A package according to claim 1 wherein said removable portions are defined by weakened lines formed on said housing.

13. A package according to claim 1 wherein when said locating means are placed together in said housing the location of the same and hence the items of apparatus are determinable with respect to said housing and said removable portions are positioned on the housing wall or walls with respect to the known item positions in said housing.

14. A package comprising:

at least one electrical apparatus having at least one component;

a housing having a plurality of sides, at least one side having a plurality of selectively removable portions for access to a component of the at least one electrical apparatus to allow a supply of power to the electrical apparatus and to allow selective operation of the electrical apparatus while retained in the package; and at least one inner sleeve having at least one open end aligned with and in communication with the selectively removable portion in a side of the housing, a top, a bottom, and first and second sides for receiving the apparatus and locating the electrical apparatus within the housing.

15. A package according to claim 14 wherein said at least one side of said housing has at least one set of a plurality of selectively removable portions for access to a set of components of the at least one electrical apparatus.

16. A package according to claim 14 wherein said at least one inner sleeve has a plurality of flaps to secure said electrical apparatus within the at least one inner sleeve.

17. A package according to claim 14 wherein said inner sleeve has at least one aperture for visual component inspection.

18. A package according to claim 14 further including a clear plastic bag having at least one opening for insertion of said electrical apparatus.

19. A package according to claim 14 wherein said housing and said inner sleeve are made from board material.

20. A package according to claim 14 wherein said removable portions are defined by weakened lines formed in said housing.

* * * * *